US009295997B2

(12) United States Patent
Harwanko et al.

(10) Patent No.: US 9,295,997 B2
(45) Date of Patent: Mar. 29, 2016

(54) SHOWERHEAD HAVING STRUCTURAL FEATURES THAT PRODUCE A VIBRANT SPRAY PATTERN

(71) Applicant: SPEAKMAN COMPANY, New Castle, DE (US)

(72) Inventors: Jeffrey B. Harwanko, Wilmington, DE (US); Alexandru Neagoe, Hockessin, DE (US)

(73) Assignee: SPEAKMAN COMPANY, New Castle, DE (US)

( * ) Notice: Subject to any disclaimer, the term of this patent is extended or adjusted under 35 U.S.C. 154(b) by 90 days.

(21) Appl. No.: 14/099,076

(22) Filed: Dec. 6, 2013

(65) Prior Publication Data

US 2014/0332608 A1 Nov. 13, 2014

Related U.S. Application Data

(60) Provisional application No. 61/821,766, filed on May 10, 2013.

(51) Int. Cl.

| | |
|---|---|
| ***B05B 1/18*** | (2006.01) |
| ***B05B 1/08*** | (2006.01) |
| ***B05B 3/04*** | (2006.01) |

(52) U.S. Cl.

CPC . *B05B 1/185* (2013.01); *B05B 3/04* (2013.01); *B05B 1/083* (2013.01)

(58) Field of Classification Search

CPC ..... B05B 1/18; B05B 1/185; B05B 1/08; B05B 1/083; B05B 3/04; B05B 3/08

USPC ..... 239/222.17, 223, 224, 240, 436, 548, 239/553.5, 556–561, 567, 568, 601

See application file for complete search history.

(56) References Cited

U.S. PATENT DOCUMENTS

| | | | | |
|---|---|---|---|---|
| 3,801,018 | A | 4/1974 | Plotz | |
| 3,958,756 | A | 5/1976 | Trenary et al. | |
| 3,963,179 | A | 6/1976 | Tomaro | |
| 4,081,135 | A | 3/1978 | Tomaro | |
| 4,117,979 | A | 10/1978 | Lagarelli et al. | |
| 4,588,130 | A | 5/1986 | Trenary et al. | |
| 5,294,054 | A | 3/1994 | Benedict et al. | |
| 5,316,216 | A | 5/1994 | Cammack et al. | |
| 5,577,664 | A | 11/1996 | Heitzman | |
| 6,715,699 | B1 * | 4/2004 | Greenberg | B05B 1/1645 239/383 |
| 7,111,795 | B2 | 9/2006 | Thong | |
| 7,114,666 | B2 | 10/2006 | Luettgen et al. | |
| 8,020,788 | B2 | 9/2011 | Luettgen et al. | |
| 8,028,935 | B2 * | 10/2011 | Leber | 239/436 |
| 2005/0001072 | A1 * | 1/2005 | Bolus et al. | 239/548 |

(Continued)

*Primary Examiner* — Len Tran
*Assistant Examiner* — Cody Lieuwen
(74) *Attorney, Agent, or Firm* — Novak Druce Connolly Bove + Quigg LLP

(57) ABSTRACT

A showerhead having structural features providing a vibrant spray pattern includes a faceplate, a turbine, and a water distributor, among other elements. The spray pattern is facilitated by the interaction of slots in the turbine, which overly troughs formed in the faceplate. The slots in the turbine meter the flow of water into the troughs. The rotation of the turbine is facilitated by a water distributor having sloped channels which direct inlet water against vanes in the turbine. A unique distribution and orientation of spray apertures and ramp configurations in the faceplate contribute to produce a vibrant spray pattern and a unique showering experience.

6 Claims, 12 Drawing Sheets

(56) References Cited

U.S. PATENT DOCUMENTS

2006/0261191 A1* 11/2006 Chang ..... 239/525
2009/0159724 A1* 6/2009 Kacik ..... 239/383
2010/0038454 A1* 2/2010 Shieh ..... 239/393
2012/0181353 A1* 7/2012 Zhou ..... A61H 9/0021 239/101
2013/0199641 A1* 8/2013 Zhou et al. ..... 137/624.27

* cited by examiner

SHOWERHEAD HAVING STRUCTURAL FEATURES THAT PRODUCE A VIBRANT SPRAY PATTERN

CROSS REFERENCE TO RELATED APPLICATION

This application claims priority to U.S. Patent Application Ser. No. 61/824,766, filed May 10, 2013. The aforementioned priority application is incorporated herein by reference in its entirety.

BACKGROUND OF THE INVENTION

1. Field of the Invention

The field of the present invention relates to showerheads that produce vibrant spray patterns.

2. Background

It has long been a goal to develop a showerhead that produces a vibrant spray pattern. Many showerheads attempt to utilize a pulsating water stream to achieve this goal.

One approach to achieving a desired spray pattern in a showerhead is disclosed in U.S. Pat. No. 7,111,795 issued Sep. 26, 2006. It utilizes a rotating impeller just upstream of a showerhead faceplate to create a revolving spray pattern flowing from the showerhead.

U.S. Pat. No. 7,114,666 discloses a showerhead with dual turbines which are selectively—not collectively—activated to produce varying spray patterns through openings in a mating faceplate. An external lever on the circumference of the showerhead enables a user to select different spray patterns.

U.S. Pat. No. 5,577,664 describes multiple paths thru a showerhead, producing different spray patterns and different flow rates. A control ring on the circumference of the showerhead is used to select the different patterns. A turbine, driven by passage of water through the showerhead, assists in creation of a pulsating stream exiting the showerhead.

Although these showerheads may be suitable for their intended purpose, a need still exists for an improved showerhead that produces a vibrant spray pattern. The present invention fulfills this need and provides further related advantages as described in the following summary.

SUMMARY OF THE INVENTION

The present invention is directed towards a showerhead which emits a vibrant spray pattern. As used herein the term "vibrant" refers to a spray pattern type in the form of multiple streams of droplets which, in aggregate, feel less harsh than a pulsating spray, but nevertheless invigorating and refreshing.

The working elements of the disclosed showerhead are best described in reverse order of water flow, i.e., from the spray apertures in the faceplate to the water inlet.

Spray apertures are formed in troughs of the faceplate. At the surface of the faceplate facing the bather, the apertures generally have a triangular shape. But, from an interior view of the faceplate, the spray apertures are positioned adjacent to ramps. The spray apertures and ramps are preferably aligned along a curvilinear path of the troughs. The ramps formed in the interior surface of the faceplate help to channel bathing water to the spray aperture. The length, shape and inclination of the ramp can be adjusted to vary the speed and direction of the water stream exiting the spray apertures. This combination of the spray aperture and ramp geometry allows for adjustment of the water spray trajectory, velocity and direction as water exits the faceplate.

In one embodiment of this invention, the troughs are preferably arcuate in shape and radiate from the geometric center of the faceplate toward the outer edge of the faceplate. These troughs are preferably about ⅛ inch deep and ⅛ inch wide, and extend radially a substantial portion of the distance from near the geometric center to outer edge of the faceplate.

The spray apertures just described are supplied with water collected in troughs formed in the upstream surface of the faceplate. Preferably, each trough has two to three spray apertures, although use of more or fewer apertures in each trough is contemplated.

Overlying the open upstream side of the troughs in the showerhead faceplate is a rotatable turbine with slots that also preferably have an arcuate shape, but opposing direction, and radiate from the center of the turbine toward its outer edge. The slots in the turbine are dimensioned to selectively cover and uncover portions of the troughs. The turbine has a central, inner opening therein to accommodate a water distributor described below that drives the turbine rotation. The turbine rotates and interacts with the upper edges of the faceplate troughs in a manner that creates a vibrant droplet spray pattern emanating from the showerhead.

The troughs in the faceplate and slots in the turbine emanate from their respective rotational axis in opposite orientations. These troughs should be oriented so that each slot in the turbine feeds multiple troughs at any given instant of operation. This adds to the unique dynamic in the shower spray emanating from the showerhead in the form of continuous droplets comprising each stream of water flowing from the showerhead.

The turbine has an upstanding wall extending about the periphery of the turbine and a wall of lesser height about an inner opening in the floor of the turbine. These walls create a temporary reservoir of water that is metered into the troughs of the faceplate through the rotating slots of the turbine.

The geometric juxtaposition of opposite patterns of the slots in the floor of the turbine and troughs in the showerhead faceplate creates constant and frequent interruptions of flow to the water coursing through the showerhead and onto the bather below. The size and orientation of slots in the turbine should be arranged to insure that each slot in the turbine supplies water to multiple troughs in the faceplate at any given instant of operation. This interaction of slots in the turbine and troughs in the showerhead contributes to the unique spray pattern, which will cascade over a user of the showerhead.

This improved distribution of the shower spray pattern is achieved largely independent of flow rate through the shower. A similar distribution can be achieved at low (1.5 gal/minute) and high (2.5 gal/minute) flow rates. With water conservation measures being strictly enforced in many parts of the world, the ability of a showerhead to emit a user friendly shower spray over a wide range of pressure is a significant commercial advantage.

Rotation of the turbine over the faceplate is accomplished by the interaction between a water distributor and upstanding vanes in the turbine. The water distributor extends through and above the wall surrounding the inner opening in the turbine. It has a stepped portion on its lower end (facing the faceplate) upon which a lip of the turbine can freely rotate. The water distributer is fixed to the exterior shell of the showerhead so that it cannot rotate.

The central portion of the water distributor contains multiple arcuate channels used to redirect the flow of water entering the showerhead onto the upstanding vanes of the turbine thereby causing the turbine to rotate as previously described.

The basic structure of the showerhead also includes a shell surrounding the water distributor and turbine. That shell is affixed to the faceplate, preferably, with complementary screw threads on the respective parts. At the upper end of the shell a ball joint is attached which allows swivel movement of the showerhead relative to a plumbed water inlet. A decorative exterior ring surrounding the shell can be added to increase the showerhead's overall consumer appeal.

The disclosed showerhead comprises minimal working parts making it economical to produce. Despite its simplicity, it produces a wholly new showering experience.

BRIEF DESCRIPTION OF THE DRAWINGS

The drawings described herein are for illustrative purposes only and not intended to limit the scope of the present disclosure. In the drawings, wherein like reference numerals may refer to similar components.

DETAILED DESCRIPTION

Figure 1:
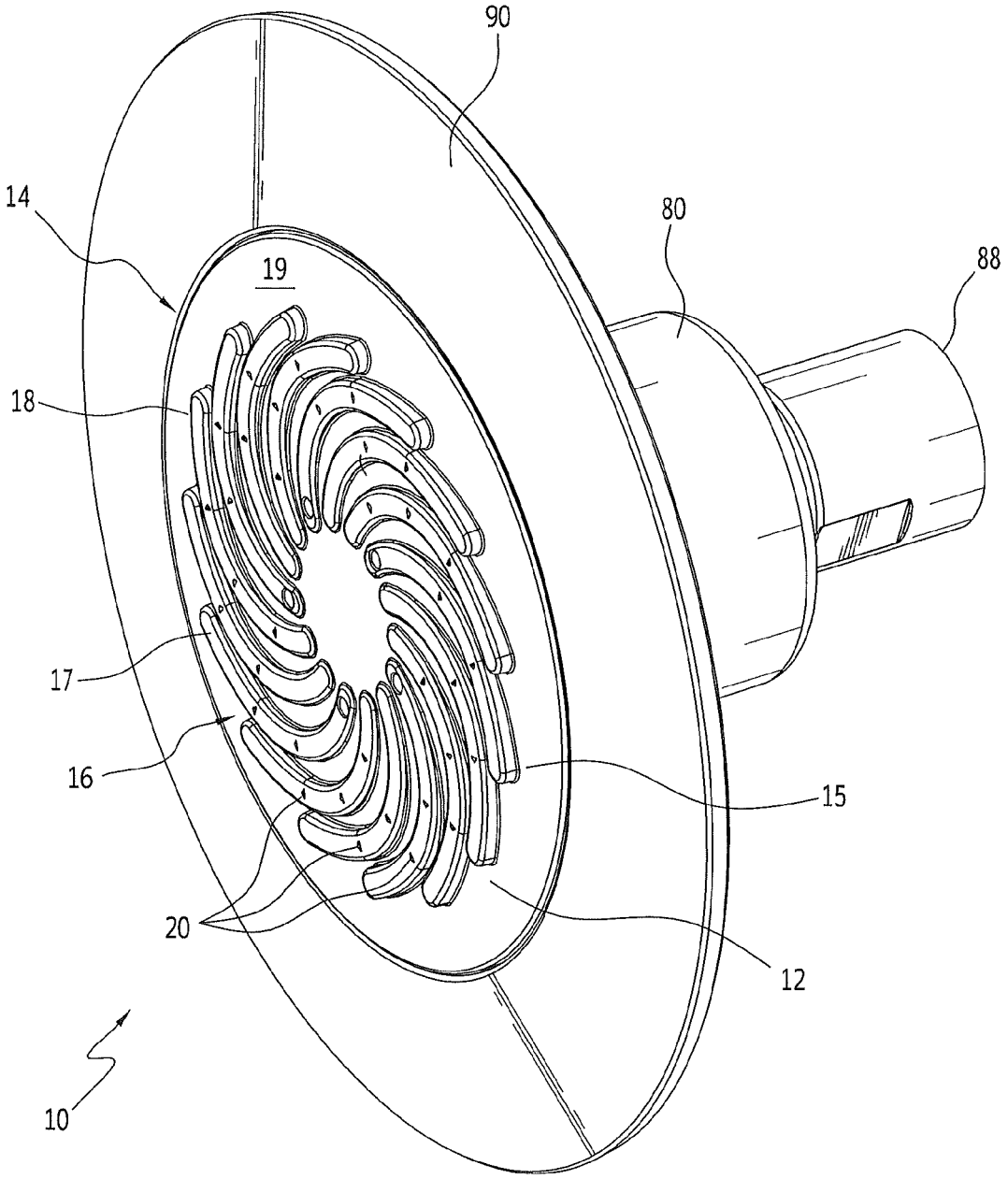
FIG. 1 is a side perspective view of an improved showerhead that produces a vibrant spray pattern.
Figure 2:
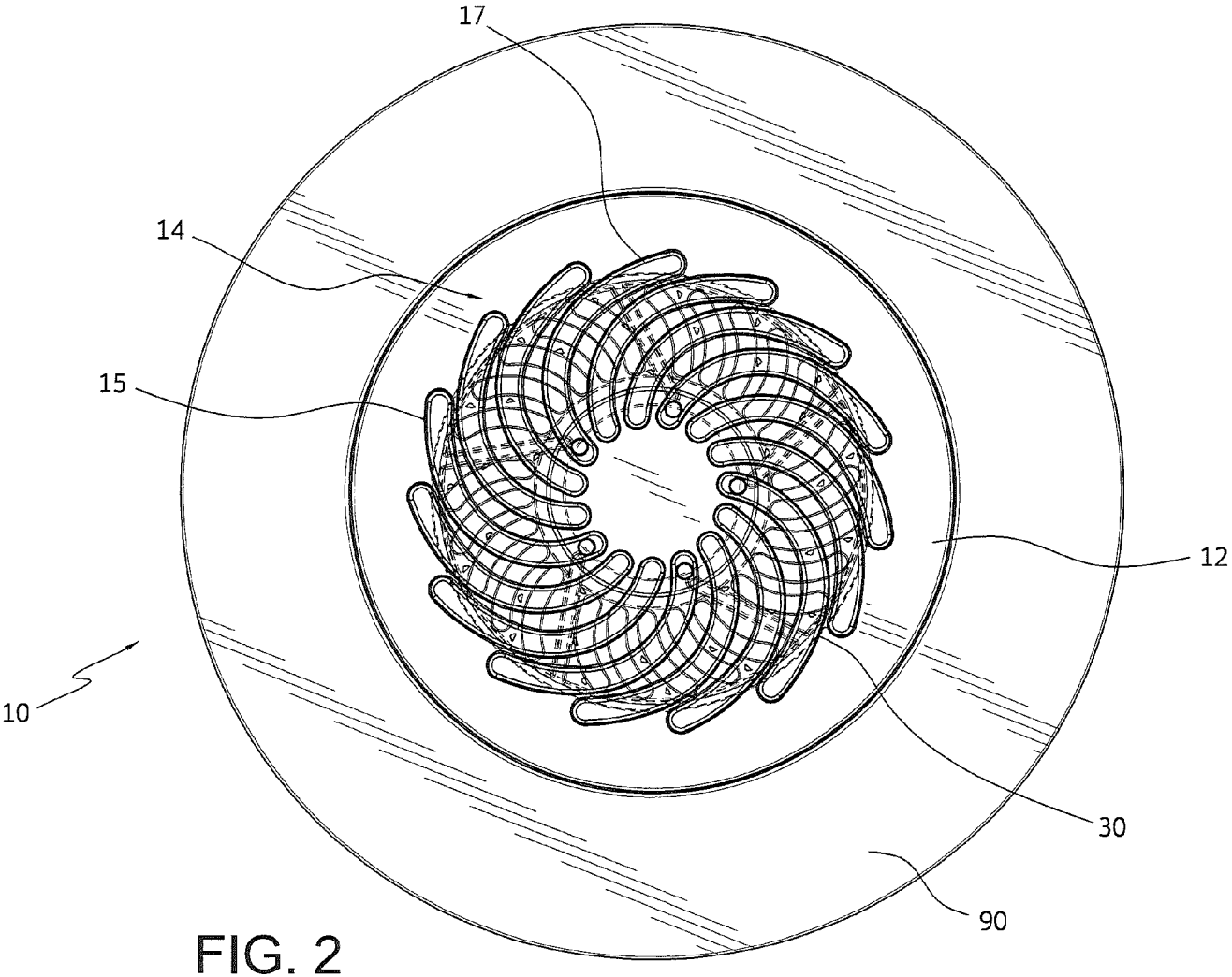
FIG. 2 is a front view of the showerhead shown in FIG. 1.

A showerhead 10 constructed in accordance with one embodiment of the present invention is shown in the drawings. The showerhead disclosed herein creates a shower spray with harmonic streams of droplets, creating a vibrant spray pattern and a distinctive sensory showering experience. The vibrant spray pattern and showering experience is accomplished in part by a unique combination of structural features, including a faceplate 12 and a turbine 30 adjacent the faceplate. FIG. 1 shows an assembled showerhead before coupling with a water source. FIG. 2 shows how the turbine 30 may be positioned against the faceplate 12, upon assembly of the showerhead 10.

Figure 3:
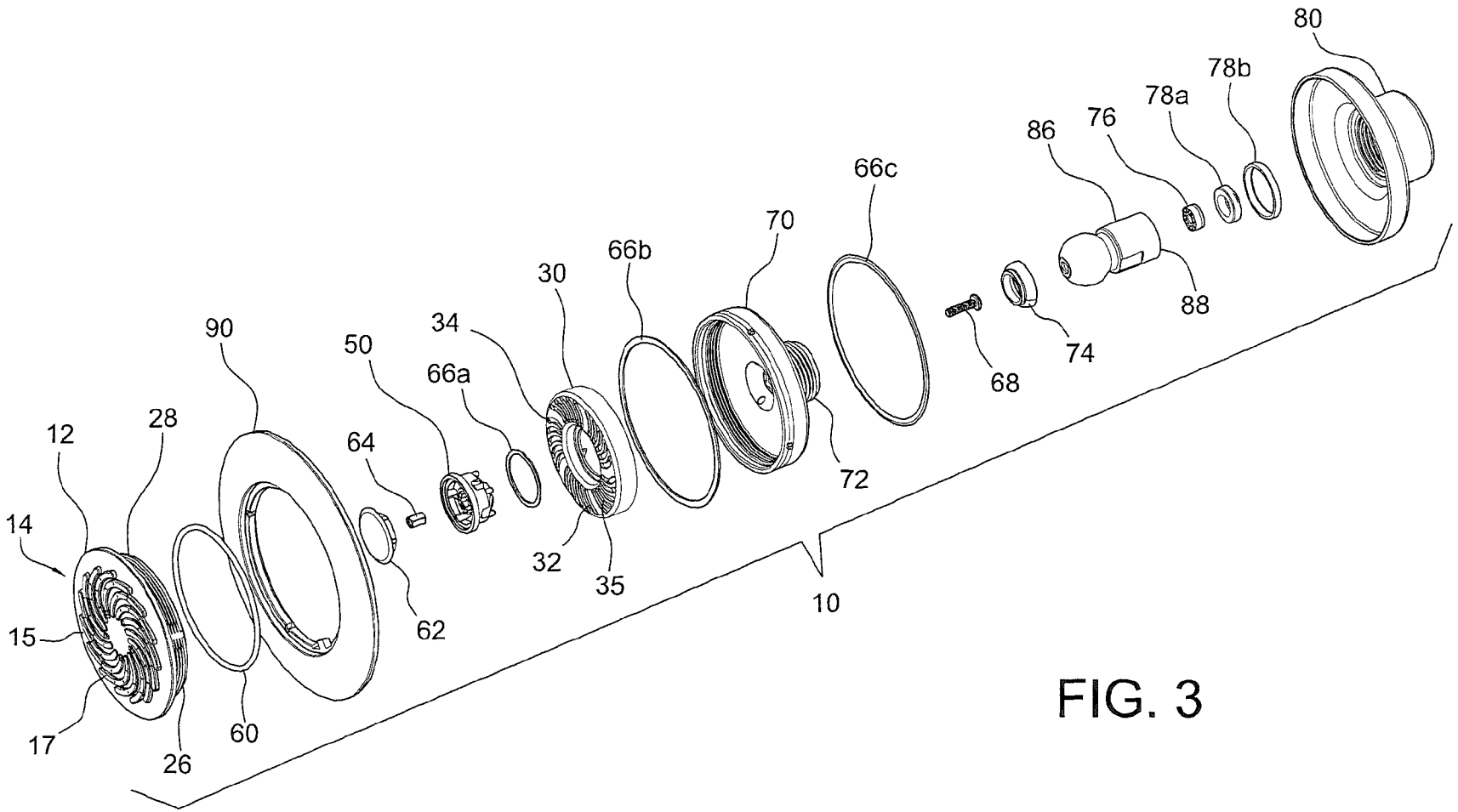
FIG. 3 is an exploded view of the showerhead shown in FIG. 1.

FIG. 3 shows an exploded view of the showerhead 10. This configuration of the showerhead includes the faceplate 12, the turbine 30, an exterior ring 90, a water distributor 50, an inner shell 70, a ball joint 86, an inlet 88, and an outer shell 80. Additional elements of the showerhead include a faceplate sealing element 60, an indexing element 62, an insert 64, a turbine washers 66*a*, 66*b*, a fastening element 68, a cup washer 74, a flow control device/adapter 76, a strainer washer 78*a*, and a ball retainer washer 78*b*. These additional elements are positioned, in part, to provide sealing, secure assembly of the showerhead, and direct water flow through the showerhead.

Referring particularly to FIGS. 1-3, the faceplate 12 includes a plurality of troughs arrayed symmetrically in a spiral-like pattern across the front surface 19 of the faceplate 12. From a front view, the plurality of troughs 14 are raised curvilinear elements 18, having an arcuate shape. Together, the plurality of troughs forms an arcuate trough pattern 15. Here, the pattern is shown with a spiral effect in a clockwise direction. Each raised curvilinear element 18 extends from a front surface 19 of the faceplate 12 and includes a plurality of spray apertures 20.

Each individual trough 17 is molded into the faceplate to hold water delivered from a water source (not shown) for a limited period until the water exits from the trough to a plurality of spray apertures 20 with at least one individual spray aperture 21 having a triangular shape. A plurality of two to three (2-3) spray apertures 20 are preferably positioned in each individual trough 17 formed in the faceplate. More or fewer spray apertures may be included, depending, in part, upon the face plate diameter. Generally, each individual spray aperture 21 in the faceplate is triangular in shape at the point where water exits from the showerhead 10. The triangular shaped aperture affects the shape of water droplets that exit from the showerhead. The shape, size, orientation, and angulation of the spray apertures, however, can be varied to provide variation in spray pattern and spread.

Figure 4:
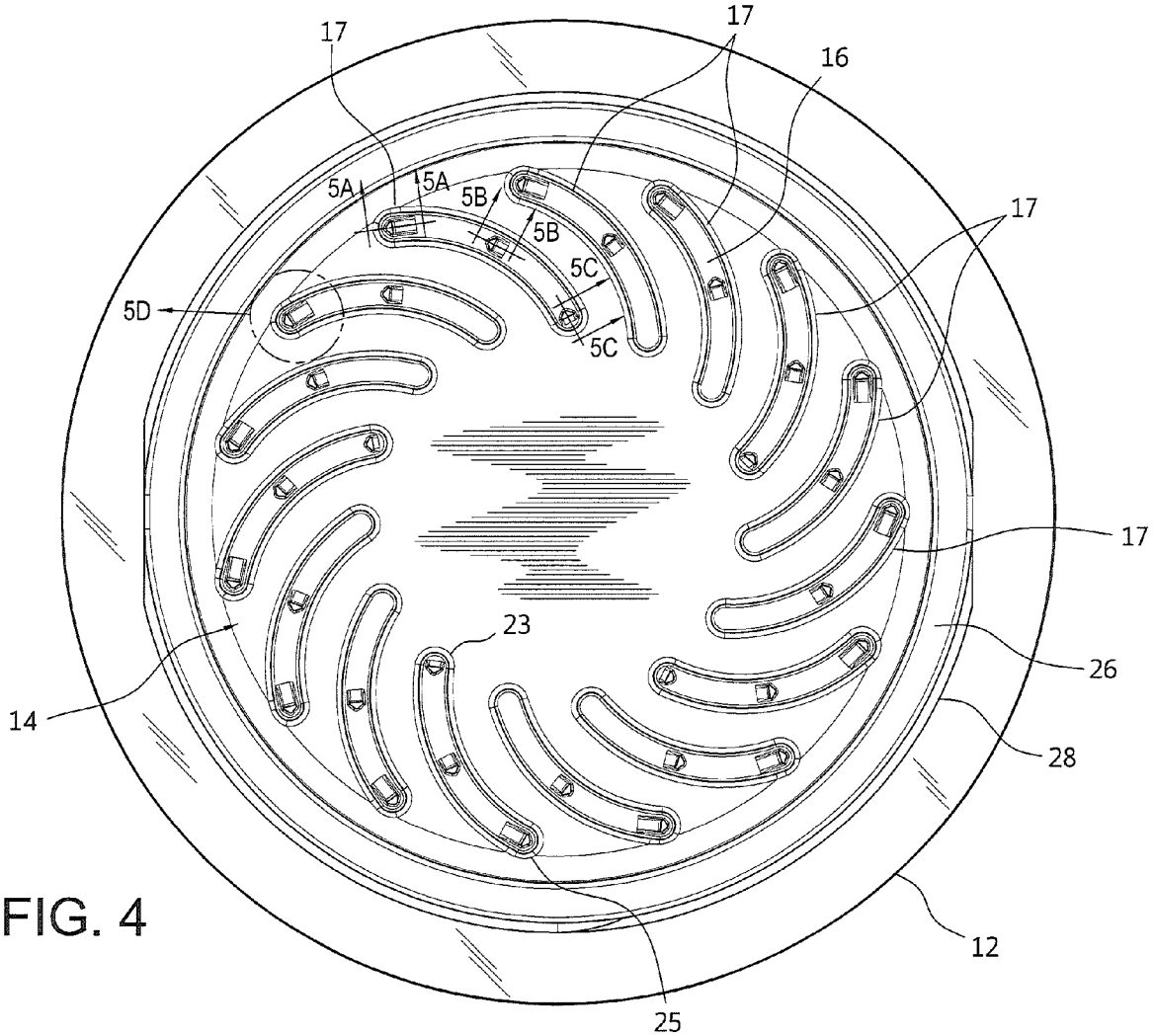
FIG. 4 is an interior view of the faceplate shown in FIG. 2, illustrating one configuration of troughs and geometry of spray apertures in the troughs.

From an interior or rear view of the faceplate, as shown in FIG. 4, the floor 16 and additional elements of the faceplate 12 facilitate water travel from an individual trough 17 to the plurality of spray apertures 20. Adjacent to each spray aperture is a ramp 2, which may vary by ramp length RL and ramp curvature RC.

Figure 5D:
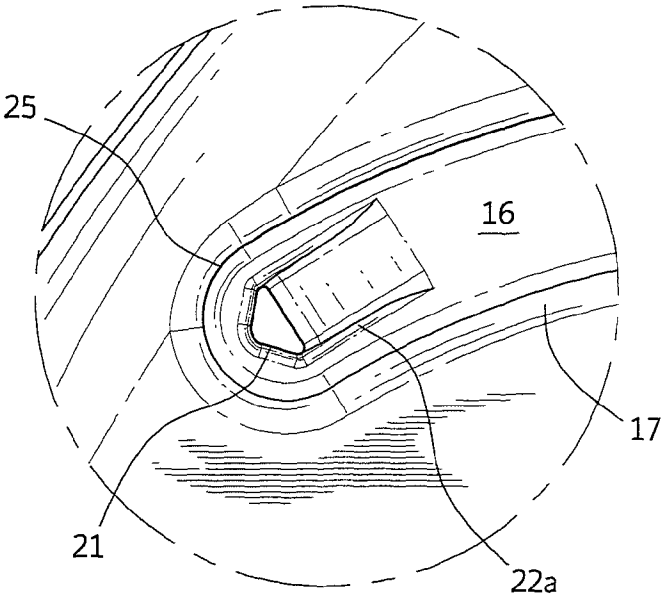
FIG. 5D is a detailed view of faceplate section 5D shown in FIG. 4.
Figures 5A, 5B, 5C:
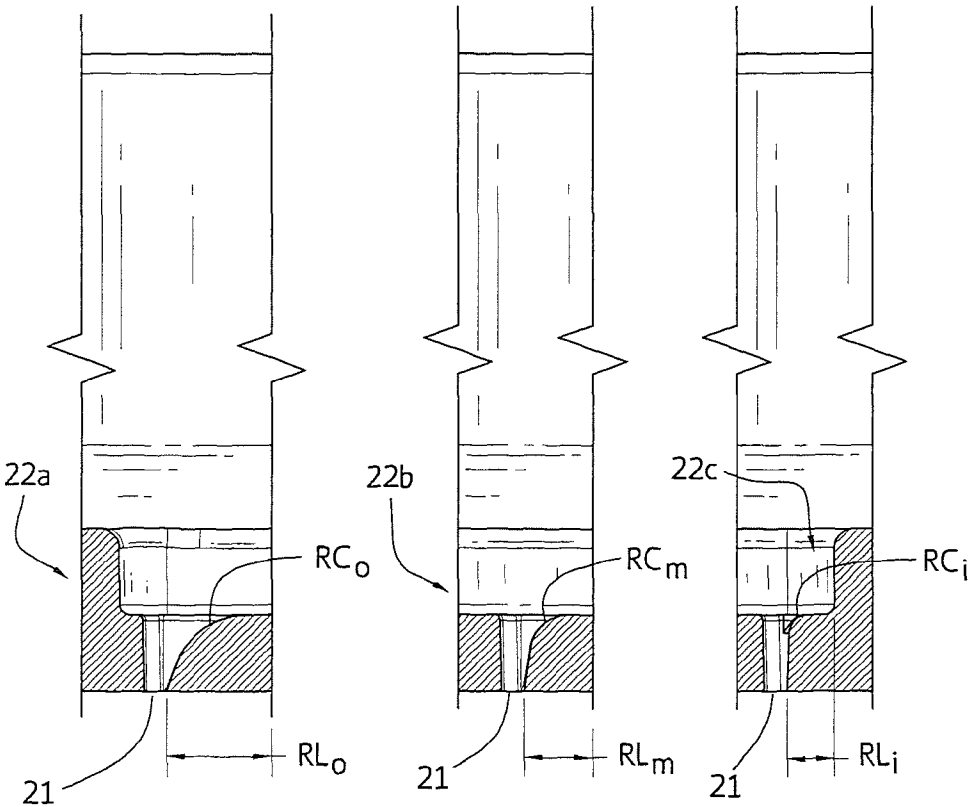
FIGS. 5A, 5B, and 5C are partial cross sectional views of the faceplate shown in FIG. 4, taken along lines 5A-5A, 5B-5B, and 5C-5C.
Figure 6:
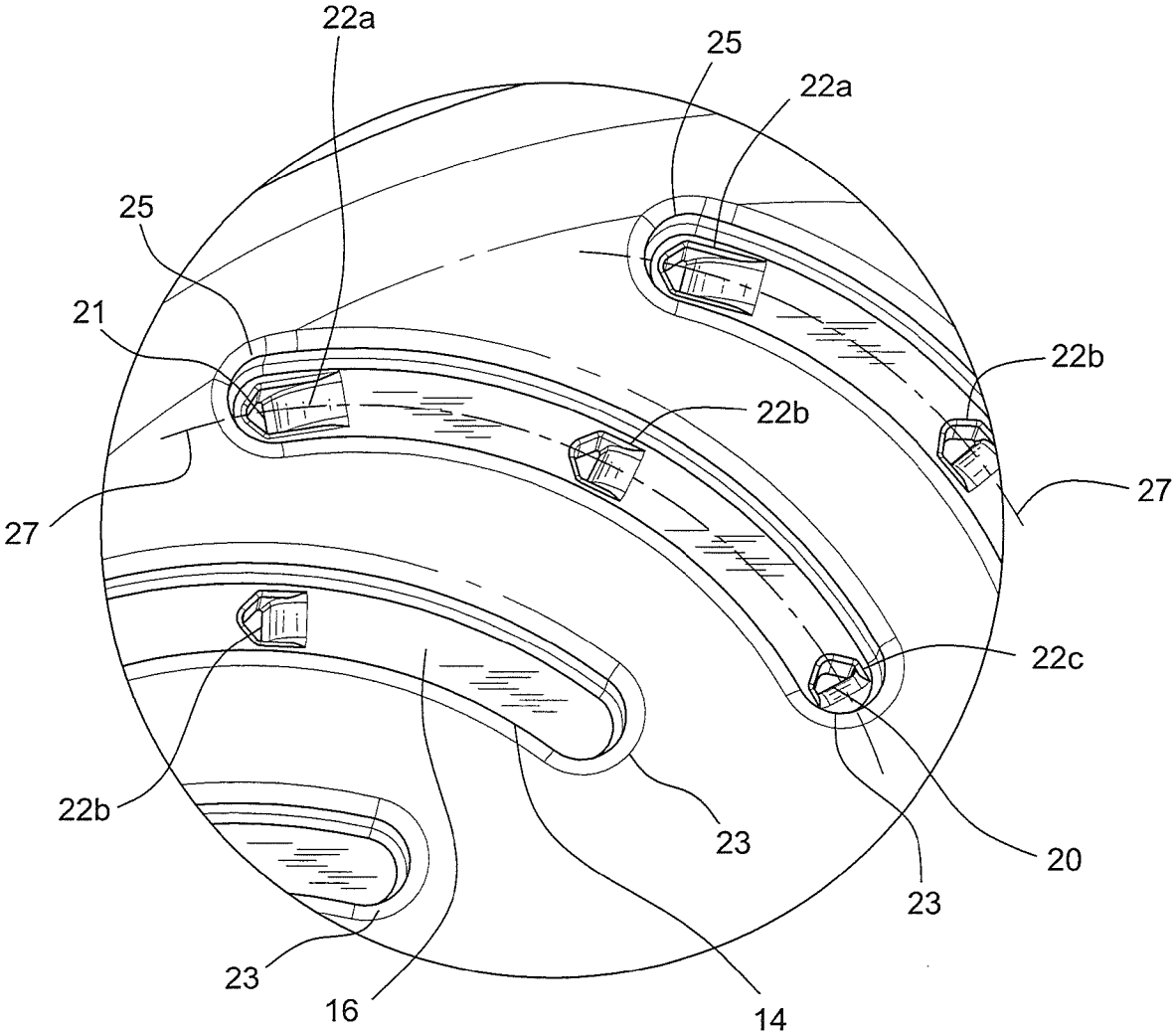
FIG. 6 is a detailed view of a section of the faceplate interior, further illustrating trough configuration and spray aperture geometry shown in FIG. 4.

One type of trough in the faceplate may include a plurality of three spray apertures 20 and three different ramp types 22*a*, 22*b*, 22*b*. (FIGS. 5A-5C). As seen in FIGS. 4 and 6, the ramp length and curvature can increase based upon where the spray aperture and ramp are positioned in the trough. In preferred configurations of the faceplate, both ramp length and ramp curvature are greater closer to an outer end 23 of the trough and smaller closer to an inner end 25 of the trough. In addition, as shown in FIG. 6, the plurality of spray apertures and the ramps are preferably aligned along a curvilinear path 27, where they are positioned at or near a midpoint of the trough width and substantially collinear with the arcuate path of the trough.

FIGS. 5A, 5B, and 5C show cross sectional views of three different ramp types 22*a*, 22*b*, 22*c*, having varying degrees of ramp length RL and ramp curvature RC. FIGS. 5A and 5D, respectively, show cross-sectional and detailed views of outer ramp type 22*a*, which is positioned closest to the outer end 23 of a trough 17. Ramp type 22*a* has a ramp curvature $RC_o$ and a ramp length $RC_o$, where o stands for "outer." Ramp type 22*b* has a ramp curvature $RC_m$ and a ramp length $RC_m$, where m stands for "middle." And, ramp type 22*c* has a ramp curvature $RC_i$ and a ramp length $RC_i$, where i stands for "inner."

In preferred configurations, at least three ramp types are included in a trough, where $RC_o > RC_m > RC_i$. Where additional ramp types are included, preferably ramp curvature RC and ramp length RL increase from the inner end 25 of the trough to the outer end 23 of the trough such that $RC_o$ and $RL_o$ are maximum and $RC_i$ and $RL_i$ are minimum. Where more than three ramp types are included additional ramp types may be positioned between the outermost ramp type and the innermost ramp type. For example, $RC_{mn}$ . . . $>RC_{m5}>RC_{m4}>RC_{m3}>RC_{m2}>RC_{m1}$, where n is an integer indicating an increase in length and curvature not more than $RC_o$ and not less than $RC_i$. As ramp length RL and ramp curvature RC increase, the larger the drops of water exiting through spray aperture and the lower the force of those drops. Conversely, as ramp length RL and ramp curvature RC decrease the smaller water drops exit with greater force. This geometry of ramp types increases the exiting speed of the spray stream from the faceplate 12. This geometry also facilitates control of the spray pattern's direction and coverage as it leaves the showerhead and cascades over the user. The location and intensity of spray patterns exiting from the showerhead 10 are further controllable by the placement and configuration of the plurality of troughs 14 in the faceplate 10 as well as the rotation of turbine 30 above the plurality of troughs 14, as described in more detail below.

In addition to the above described impact of ramp design in each trough, the design of the troughs shown in the drawings adds an aesthetic dimension to the appearance of the showerhead. However, any generally radiating or spiral-like pattern of troughs can be used as long as that pattern facilitates filling of multiple troughs at any given time. Each individual trough 17 is preferably arcuate in shape.

Figure 9:
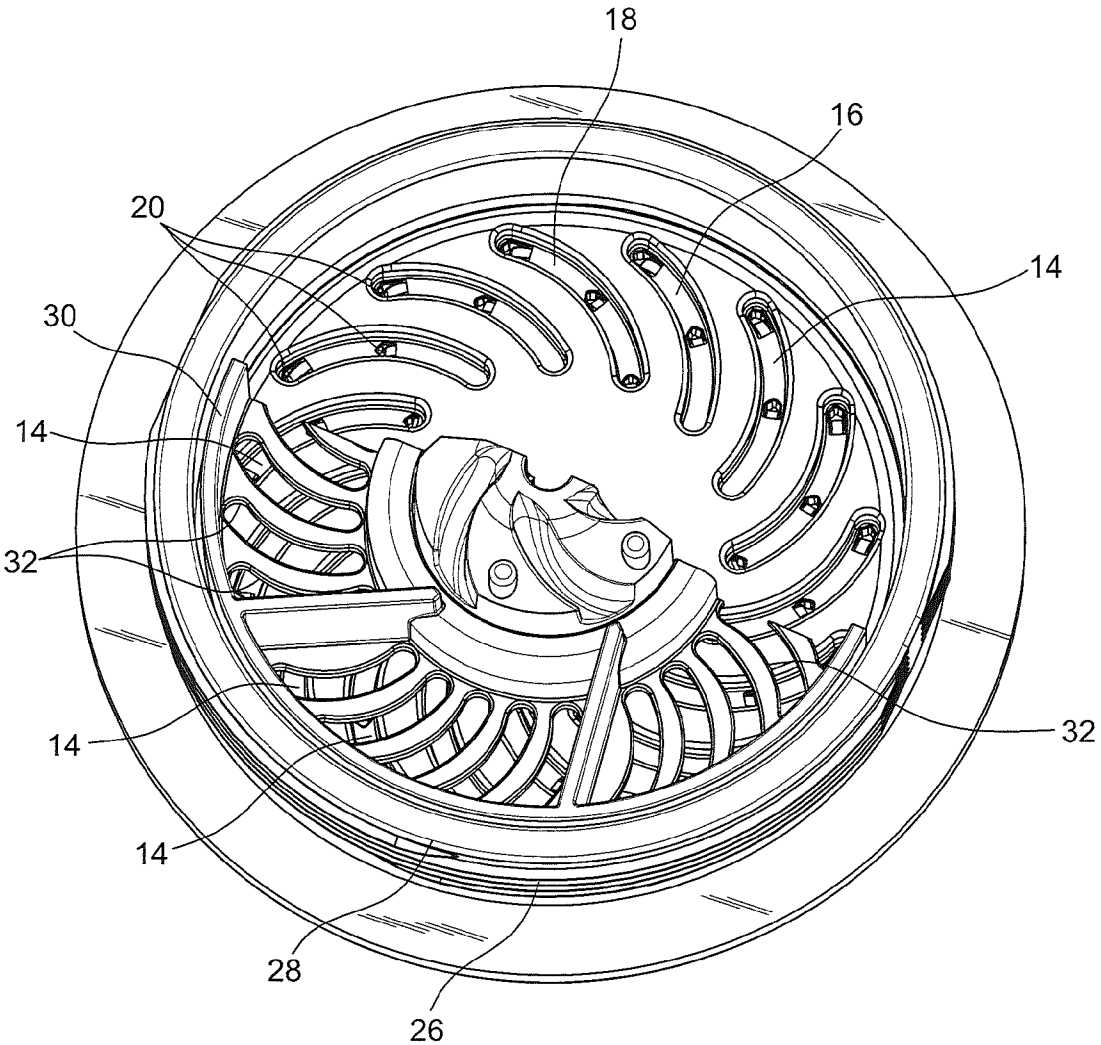
FIG. 9 is a partial cross-sectional view of turbine slots overlying faceplate troughs.

To provide a physical waterproof connection of the faceplate 12 to the remaining elements of the showerhead, an upstanding collar 26 with external threads 24 extends perpendicular to the faceplate. (FIGS. 23 and 9). The external threads 28 on collar 26 threadingly engage inner shell 70 (FIG. 3) to form an enclosed area of the showerhead in which the desired spray pattern is created.

A decorative exterior ring 90 is preferably attached to faceplate 12 or inner shell 70 to add dimension and decorative appeal to the showerhead. For example, the exterior ring 90 can be molded from one or more transparent or translucent materials and given an appealing pastel color such as Pantone Dusk Blue, (16-4120). Ambient light shining through such a ring 90 provides an attractive focal point for users of the shower. The faceplate 12 may also be molded from one or more transparent or translucent materials so that counter-rotation of turbine 30 can be observed.

Returning to the faceplate 12, as shown particularly in FIGS. 4-6, each individual trough 17 in faceplate 12 has an open area capable of receiving and holding shower water before it exits an individual spray aperture 21. The number of troughs to be placed in a showerhead is typically a function of the overall size of the showerhead 10. As illustrated in FIG. 2, approximately 15 troughs are formed in the faceplate 12, however, fewer or more troughs can be used. One function of the troughs 14, is to evenly distribute water to the plurality of spray apertures 20 emanating from each trough. The geometry of each individual trough 17 and ramp 22, in conjunction with a turbine 30 described below, help to create the desired spray pattern.

Figure 7:
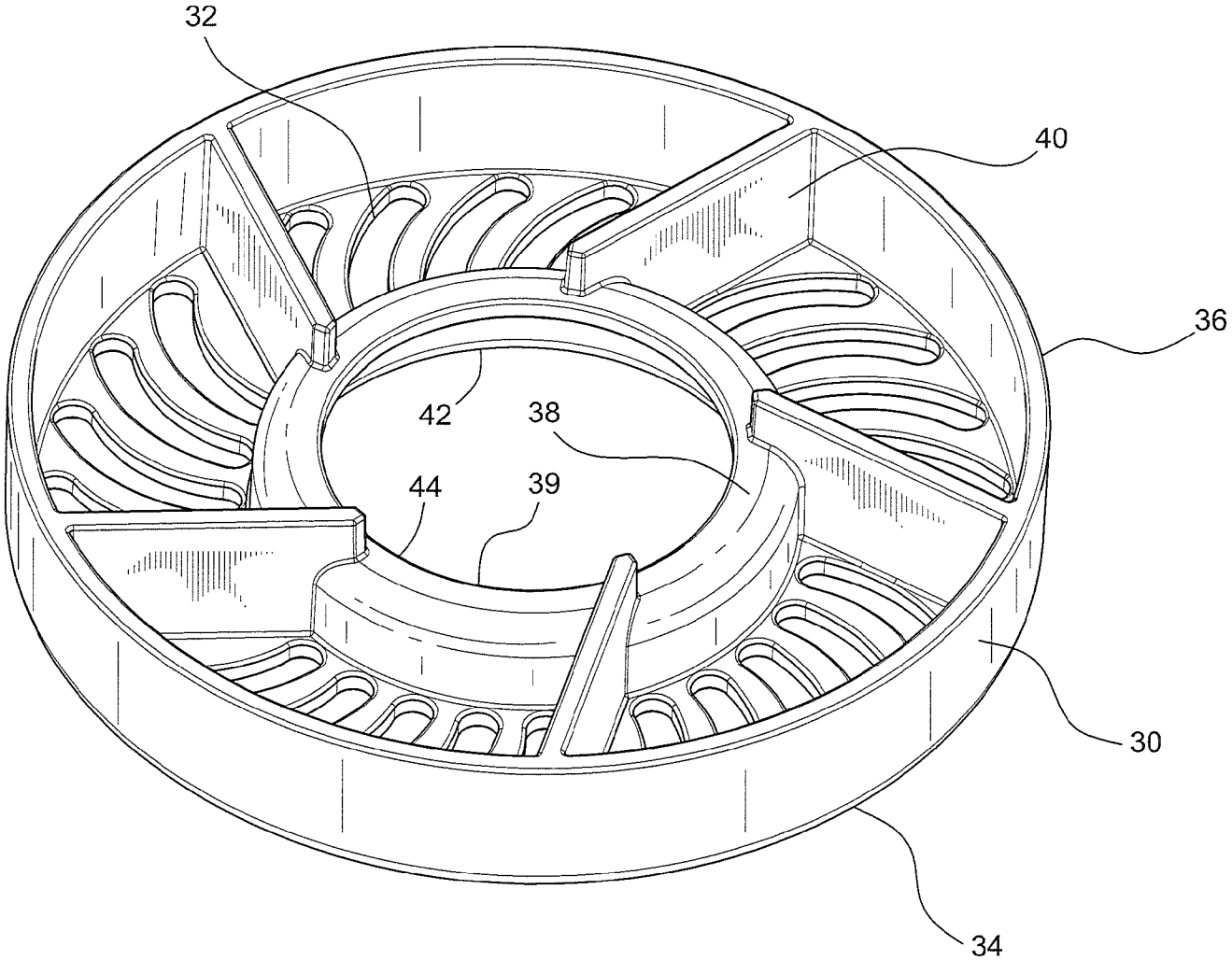
FIG. 7 is a perspective view of the turbine shown in FIG. 1.

FIG. 7 shows one configuration of a turbine 30. The turbine is rotatable and therefore is configured to rotate as water flows from a water source through the showerhead. The turbine structure generally includes a turbine base 34 with a central base opening 42 formed therein, an outer upstanding wall 36, an inner upstanding wall 38 with a central inner opening 44, and a plurality of vanes 40 positioned at radial intervals and coupled to the outer upstanding wall and the inner upstanding wall. The outer upstanding wall has an outer circular dimension close to that of an inner diameter of the upstanding collar 26 on the faceplate. The turbine also includes a plurality of slots 32 positioned in the base 34. The plurality of slots preferably form an arcuate slot pattern 35 (FIG. 3) that radiates in a direction opposite that of the arcuate trough pattern 15 of the faceplate 12. To help contain water within the turbine 30 and assist in its rotation, multiple turbine vanes 40 are placed between an inner upstanding wall 38 and an outer upstanding wall 36 on the periphery of the turbine. The plurality of turbine vanes 40 assists in propelling rotation of the turbine with its slots 32 over the troughs 14 of the faceplate 12.

Figure 10:
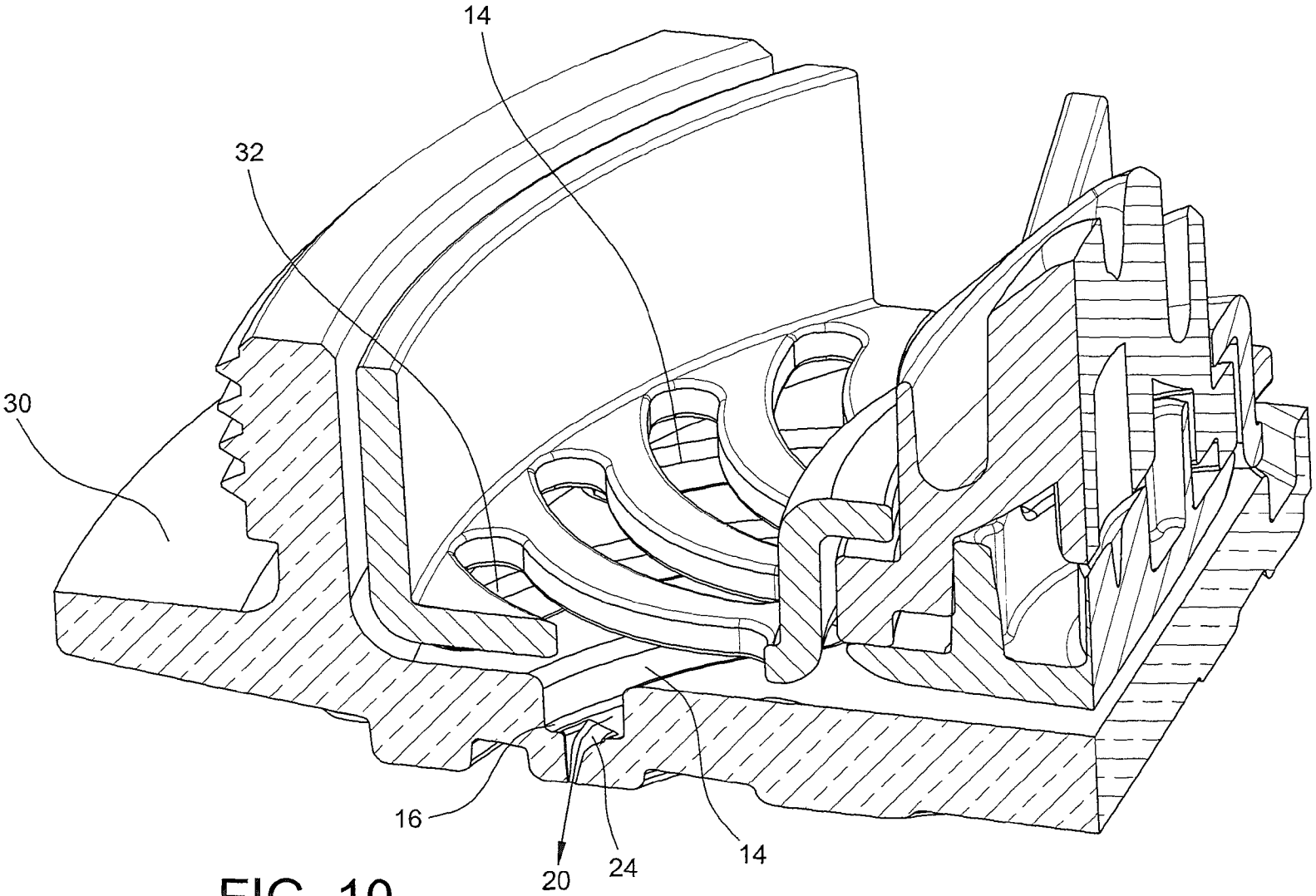
FIG. 10 is an enlarged cross-section of the turbine overlying a trough as it empties into a spray aperture.

As shown particularly in FIGS. 9 and 10, the plurality of slots 32 are configured to pass over a complementary plurality of troughs 14 in a manner in which only a small area of an individual slot 33 is positioned over an individual trough 17 during any given instant of showerhead operation. This rotation of the plurality of slots 32 relative to plurality of troughs 14 lets a continuously varying amount of water into the troughs as the turbine rotates. This rotation and dimensioning of the slots also assures that each slot is distributing water into the multiple troughs at any given time. The opposing orientation of the pluralities of turbine slots 32 and troughs 14 helps to create the desired volume entering and exiting the spray apertures 20 through the showerhead 10. This fluctuation also helps to create the vibrant spray pattern of the water exiting from the showerhead.

Figure 8:
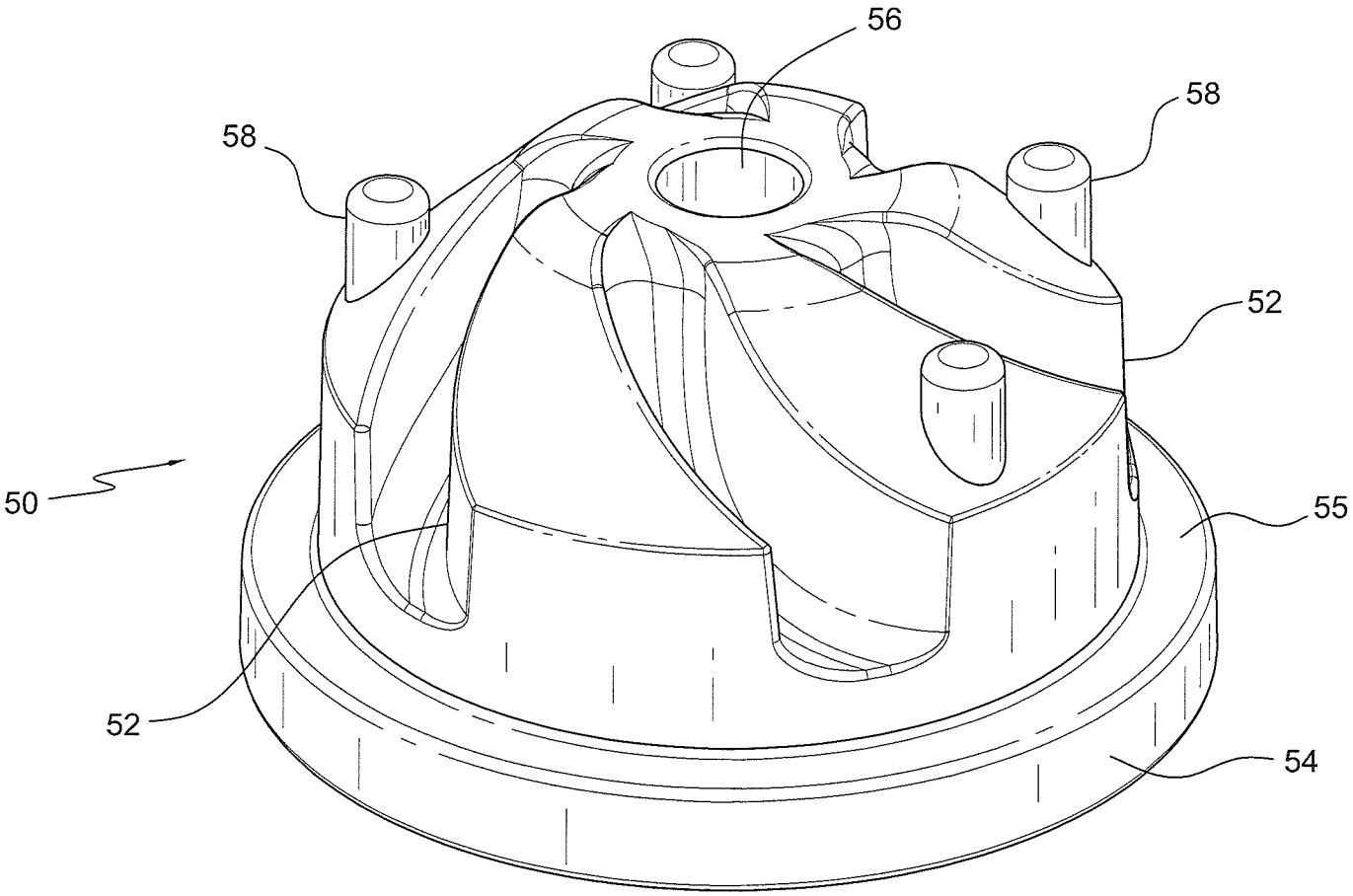
FIG. 8 is a perspective view of the water distributor shown in FIG. 1.

Upon assembly of the showerhead, the turbine 30 freely rotates around, and on, a water distributor 50. One configuration of a water distributor is shown in FIG. 8. The water distributor 50 includes an upper section 51, a base section 54, and a hole 56 that extends through the upper section and the base. A plurality of downwardly sloped channels 52 is formed in the upper section 51 to divide water entering the showerhead into multiple paths. As the water flows down the channels 52 the orientation and size of those channels emit water at a relatively high speed, striking the vanes 40 of turbine 30 and causing the turbine to rotate at a relatively high speed. The water distributor 50 is fixed in nonrotating position within the showerhead by upstanding locating pins 58 which fit into matching recesses in inner shell 70 (See FIG. 11). The base has a horizontal upper edge 55 on which a rim 39 of the inner upstanding wall 38 of turbine 30 rests.

The unique spray pattern of the subject showerhead is enabled in part by the design and orientation of the turbine slots 32 over troughs 14 in the faceplate 12. The opposite orientation of slots 32 and troughs 14 provides a constantly changing amount and source of water to the spray apertures 20. Also, because the slots 32 of turbine 30 cut off water supply to the troughs as they sweep across the troughs there is a constant interruption of flow into the troughs which gives a feeling akin to pulsation, but substantially different from a pulsating flow typically found in a pulsating showerhead. As shown in the lower left quadrant of FIG. 9, a single slot 32 of turbine 30 overlies the plurality of troughs 14 in the underlying faceplate. As that slot continues to rotate it will supply water to other troughs and halt supply of water to troughs it just passed. This constant and rapid interruption of the pressurized water supply to the troughs helps create the unique spray pattern of the claimed showerhead.

In an assembled showerhead, a turbine 30 overlies the troughs 14 in faceplate 12. (FIG. 2). And, as shown in FIG. 9, the water turbine 30 includes slots 32 which are configured to overly the troughs 14 in faceplate 12.

Figure 11:
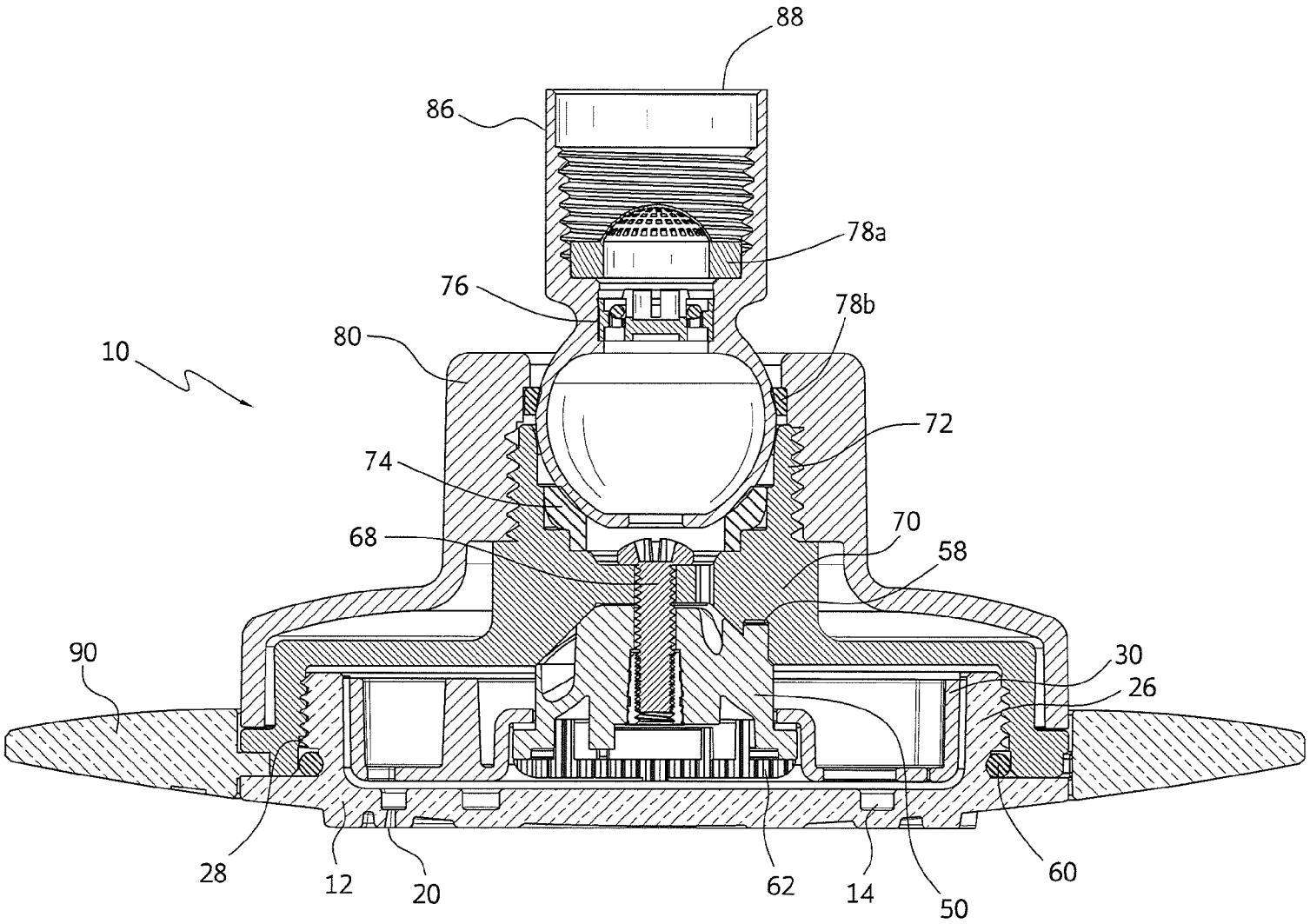
FIG. 11 is a cross-sectional view of a showerhead embodiment.

FIG. 11 shows a cross-section of one configuration of an assembled showerhead 10 before attachment to a water source/inlet. Among other elements, the structure of showerhead 10 includes an outer shell 80 and ball joint 86. The outer shell 80 sealingly engages threads 72 on the outer periphery of inner shell 70. Rounding out the exterior structure of the showerhead 10 is the faceplate 12 which is attached to the inner shell 70. Ball joint 86 is a standard ball joint, which allows a showerhead to swivel in relation to the water source/inlet and contains a flow control device/adapter 76 to regulate the amount of water flowing through the showerhead in accordance with local codes.

Figure 12:
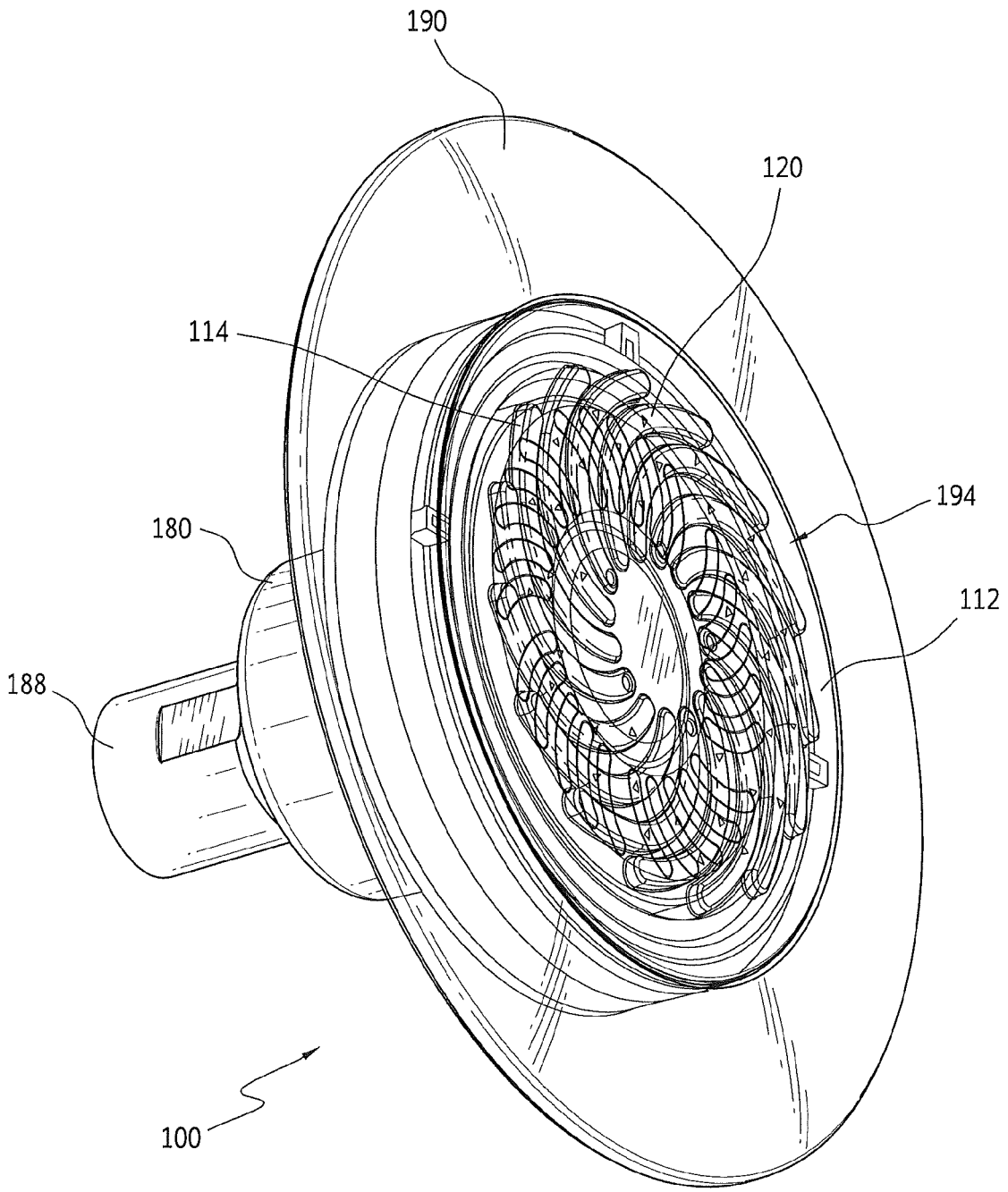
FIG. 12 is a pictorial view of a showerhead, showing a decorative exterior ring surrounding the faceplate.

FIG. 12 shows a perspective view of another embodiment of a showerhead 100 that includes a transparent or translucent faceplate 112 and a transparent or translucent exterior ring 190. Other elements of the showerhead are consistent with those shown in FIG. 3. The transparency or translucency of the faceplate is such that the turbine 130 may be viewed during use, while the turbine is rotating. From a viewer's perspective, a kaleidoscope-like effect 194 occurs, due in part to the opposing directions of the plurality of turbine slots 132 and the plurality of faceplate troughs 114. This kaleidoscope-like effect is particularly apparent, where the turbine is manufactured from a material having a contrasting color than that specified for the translucent or transparent faceplate.

While embodiments of this invention have been shown and described, it will be apparent to those skilled in the art that many more modifications are possible without departing from the inventive concepts herein. The invention, therefore, is not to be restricted except in the spirit of the following claims.

The invention claimed is:

1. A showerhead emitting a vibrant spray pattern comprising an inlet in an upstream end of the showerhead for receiving water from a water source;

an outer showerhead body sealingly connected to the inlet;

a stationary faceplate sealingly connected to a downstream end of the showerhead body wherein the faceplate includes;

multiple elongated troughs for temporary storage of water therein generally parallel to the plane of the faceplate, radiating from the center of the faceplate and formed as a recess in an upstream surface of the faceplate;

the faceplate troughs having one or more spray apertures therein extending through a downstream surface of the faceplate;

at least one faceplate ramp surface in the troughs extending from a downstream surface of the troughs to the spray apertures in the faceplate;

and a rotatable turbine with water outlets therein and with each outlet overlying an upstream edge of multiple troughs in the faceplate;

whereby rotation of the turbine delivers water to the multiple faceplate troughs for ultimate discharge from spray apertures in the faceplate.

2. The showerhead of claim 1 wherein the rotatable turbine also includes upstanding radial and peripheral walls to facilitate temporary storage of water before entering the faceplate.

3. The showerhead of claim 1 wherein the troughs in the faceplate include two or more ramp surfaces with different ramp slopes and length.

4. The showerhead of claim 1 wherein the troughs in the faceplate are curvilinear in shape.

5. The showerhead of claim 1, further comprising a water distributor with downwardly sloped channels directing water from the inlet to the turbine.

6. The showerhead of claim 1 wherein the spray apertures in the faceplate are triangular in cross section.

* * * * *